US005218839A

United States Patent [19]

Udko

[11] Patent Number: 5,218,839

[45] Date of Patent: Jun. 15, 1993

[54] JEWELRY SETTING

[75] Inventor: Richard W. Udko, Beverly Hills, Calif.

[73] Assignee: Unigem International, Beverly Hills, Calif.

[21] Appl. No.: 934,266

[22] Filed: Aug. 25, 1992

[51] Int. Cl.[5] ..... A44C 17/02

[52] U.S. Cl. ..... 63/26; 63/28; 63/29.1

[58] Field of Search ..... 63/26, 28, 29.1, 15

[56] References Cited

U.S. PATENT DOCUMENTS

| | | | |
|---|---|---|---|
| 836,479 | 11/1906 | Allen | 63/26 |
| 860,204 | 7/1907 | Fishel | 63/28 |
| 1,400,460 | 12/1921 | Rosenthal | 63/28 |
| 1,421,339 | 6/1922 | Zalowitz | 63/28 |
| 1,449,158 | 3/1923 | Wittstein | 63/26 |
| 1,850,728 | 3/1932 | Schless | 63/26 |
| 3,626,718 | 12/1971 | Schneider | 63/29.1 |
| 5,044,177 | 9/1991 | Favre | 63/26 |

FOREIGN PATENT DOCUMENTS

| | | | |
|---|---|---|---|
| 851419 | 10/1952 | Fed. Rep. of Germany | 63/29.1 |
| 429266 | 7/1967 | Switzerland | 63/29.1 |
| 159451 | 3/1921 | United Kingdom | 63/28 |
| 235779 | 6/1925 | United Kingdom | 63/26 |
| 791944 | 3/1958 | United Kingdom | 63/28 |
| 208455 | 4/1982 | United Kingdom | 63/26 |

*Primary Examiner*—Peter M. Cuomo
*Assistant Examiner*—Michael Milano
*Attorney, Agent, or Firm*—Michael A. Painter

[57] ABSTRACT

A jewelry setting for a gemstone which provides the illusion or otherwise simulates the appearance of a larger gemstone. The setting comprises a collar having an axial, cylindrical bore disposed therethrough. A V-shaped cut is formed in the surface of the cylindrical bore perpendicular to the longitudinal axis of the collar. The collar is adapted to secure the gemstone for mounting. The apex of the V-shaped cut defines a circle substantially equivalent to the girdle of the gemstone and lies in a plane which is perpendicular to the longitudinal axis of the collar. The intersecting surfaces of the V-shaped cut are adapted to be adjacent a portion of the pavilion and crown of the gemstone. The upper surface of the collar uniformly circumscribes a segment of the crown of the gemstone and thereby permits display of the gemstone table and the uncovered portion of the crown. The upper surface of the collar may be etched or otherwise inscribed with indicia which simulate the appearance of girdle, bezel and crown facets.

11 Claims, 2 Drawing Sheets

JEWELRY SETTING

BACKGROUND OF THE INVENTION

1. Field of the Invention

The present invention generally relates to a jewelry setting for holding and securing a gemstone such as diamonds or other precious and/or decorative stones and, more particularly, a jewelry setting which simulates the appearance of a larger gemstone.

2. Prior Art

Diamonds or other gemstones are typically secured in settings which utilize prongs or channels. In a prong set, a plurality of prongs are conventionally provided around the periphery or girdle of the stone to fix it in position and to insure that it does not move laterally. In such a setting, each prong must be individually tightened against the girdle and crown of the stone in order to obviate lateral movement. In addition, each prong tip is bent around the girdle of the stone so that the tips will grip or impose pressure on the crown of the stone. In order to adjust the prongs against the stone so that it is secured, a laborious manual operation must be performed. In a channel set, the stones are maintained in place by the channel surfaces which are disposed over a portion of the crown of the gemstone.

Due to the high cost of diamonds and other precious stones, methods have been developed whereby a stone of a given size may be simulated by a setting within which a smaller stone is mounted. One of the earliest settings for enhancing the appearance of a smaller stone utilizes a clamping ring which has an upper surface which conforms to the appearance of the exposed surface of the stone while presenting an edge over which the prongs of the ring could be bent in the conventional manner. The inadequacies of this setting and method center on the manner in which the stone is secured within the setting. The clamping ring is not secured to the stone. To the contrary, it is adapted to engage the crown of the stone by imposing force thereon. This makes it difficult to properly secure the clamping ring to the setting for the purpose of mounting and orienting the stone in a manner which would allow the smaller stone to simulate the appearance of a larger stone. The present invention overcomes these inadequacies by imbedding or otherwise securing the stone within a collar. The combination of the collar and mounted stone may then be set within the jewelry in question utilizing conventional prong or channel settings.

Another method taught by the prior art enhance the appearance of a stone by mounting same within a bezel. The stone is secured within the bezel by a plurality of prongs which bear against the crown of the stone. To provide enhanced appearance, the surface area intermediate the prongs are inscribed to simulate facets. The problems inherent in this method lie in the extreme difficulty in mounting the stone within the bezel. When working with stones having small diameters (i.e., less than 3 millimeters), prongs must be used which are extremely small if they are to contact only the crown of the stone. Given the relative dimensions of the bezel, prongs and the stone to be mounted, this method is inefficient, difficult to perform and can lead to the insecure mounting of the stone.

The present invention resolves those inadequacies exhibited by the settings and methods taught by the prior art. The enhanced appearance of a small stone is accomplished by securing the stone within an axial bore of a mounting collar. The stone is imbedded within the bore of the collar, the upper portion of the collar being adjacent to and circumscribing a portion of the crown of the stone. When the table and crown of the stone are visually combined with the visible upper surface area of the collar, a stone of a given weight can simulate or give the illusion of the appearance of a stone 250% larger. As an example, a 2 point diamond mounted in accordance with the present invention will exhibit a surface area equivalent to a 5 point diamond.

SUMMARY OF THE INVENTION

The present invention comprises a jewelry setting which will allow a small gemstone to simulate the appearance of a gemstone which is 250% larger. For convenience, the gemstones to be mounted in the subject setting will be referred to a diamonds, it being understood that other precious, semi-precious and non-precious decorative gemstones may be used. The present invention comprises a combination of a small diamond which is integrally mounted within a defined collar. The diamond is mounted within the collar in a manner which will exhibit its table, star facets, girdle facets and the bezel or crown main facets.

The collar employs a downwardly tapered outer surface and an inner cylindrical bore aligned along the longitudinal axis of the collar. A V-shaped cut is formed in the surface of the cylindrical bore, the apex of the V-shaped cut being substantially equivalent to the girdle of the diamond. The diamond is secured within the cylindrical bore of the collar, the apex of the V-shaped cut being aligned with the girdle of the stone. When in place, the intersecting surfaces of the V-shaped cut engage portions of the pavilion and the crown. The pavilion extends downwardly into the cylindrical bore, the table and a portion of the crown and star facets being visible at the upper surface of the collar.

The upper surface of the collar comprises a pair of annular surfaces, the interface formed by the intersection of the surfaces being in a planar relationship with the table of the diamond. The apparent size of a diamond and collar assembled in accordance with the present invention is the equivalent to the outer diameter of the upper surface of the collar. This will simulate the appearance of a stone 250% the size of the mounted stone.

It is therefore an object of the present invention to provide a jewelry setting which simulates the appearance of a larger stone.

It is another object of the present invention to provide a jewelry setting which is decorative so as to enhance the appearance of the jewelry.

It is still another object of the present invention to provide a jewelry setting having a visible surface which enhances the brilliance and dimension of the mounted stone.

It is still yet another object of the present invention to provide a jewelry setting which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

The present invention comprises a setting for a gemstone which allows the gemstone to give the illusion of the appearance of a larger stone. Although the present invention can be equally practiced with precious and non-precious gemstones, for the purpose of example the preferred embodiment will be described with respect to a diamond.

Figure 1:
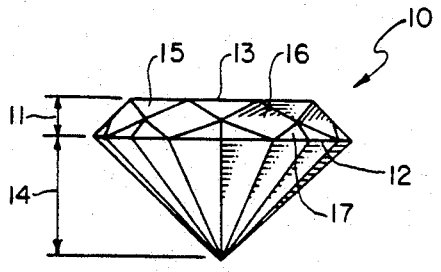
FIG. 1 is an illustration of a gemstone illustrating the various elements making up the appearance of the gemstone.

FIG. 1 illustrates a side elevation view of a diamond exhibiting the visual elements thereof, the diamond being generally designated by the reference numeral 10. The crown portion of the diamond 10 is designated by the reference numeral 11 and extends upwardly from the girdle 12. Crown 11 will be deemed to cover the entire portion of the diamond extending upwardly from girdle 12 including the table 13. The pavilion 14 covers the entire portion of the diamond 10 extending downwardly from the girdle 12. The girdle 12 of diamond 10 is substantially circular, the visual elements of the crown 11 representing the ornamental features thereof. The visual elements of the crown 11 comprise table 13, star facets 15, bezel facets or crown main facets 16 and crown girdle facets 17.

It is an object of the present invention to provide a setting in which a diamond of a given size will simulate the appearance of a diamond which is 250% larger. As an example, for a diamond in the form shown in FIG. 1, the diameter of the girdle 12 of a 2 point diamond is 1.7 millimeters. When mounted in accordance with the present invention, a 2 point diamond will give the appearance of a 5 point diamond, the diameter of the girdle 12 thereof being 2.4 millimeters. In a like manner, in accordance with the present invention, a 4 point diamond will simulate the appearance of a 10 point diamond.

An understanding of the present invention can be best gained by reference to FIGS. 2-5. For the purpose of this description, the jewelry setting described shall be deemed to be an assembly of a diamond 10 mounted within a collar 20. The diamond shown in FIG. 1 is mounted within the collar shown in FIG. 2 and FIG. 3. Collar 20 has an annular shaped body 21 having a central, cylindrical bore 22 disposed therethrough which is aligned with the longitudinal axis 23 of collar 20. The upper portion of annular body 21 comprises a pair of concentric, intersecting surfaces 24 and 25. The intersection 26 of outer concentric surface 24 and inner concentric surface 25 defines the upper extent of annular body 21. The outer diameter of collar 20 is defined by the outer edge 28 of outer concentric surface 24. Depending downwardly from outer edge 28, engagement surface 29 comprises a partial conical section which will be received by the jewelry into which the present invention is mounted. To provide sufficient depth, the angle of intersection between outer concentric surface 24 and partial conical section 29 is approximately 100° of arc. Since collar 20 is to contribute to the enhancement in appearance of diamond 10, it is typically constructed of a highly reflective metal such as silver, gold or platinum.

Figure 2:
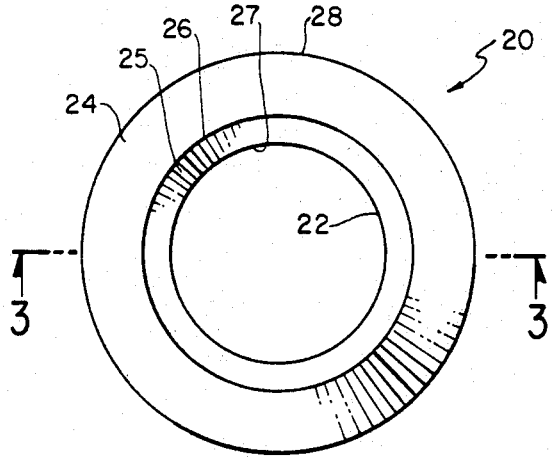
FIG. 2 is a top plan view of a mounting collar in accordance with the present invention.
Figure 3:
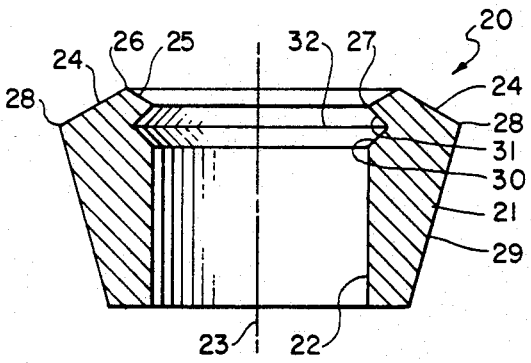
FIG. 3 is a side elevation, cross-sectional view of the mounting collar shown in FIG. 2 taken through line 3—3 of FIG. 2.

As shown in FIGS. 2 and 3, a V-shaped cut is formed into the cylindrical bore 22 adjacent the inner edge 27 of inner concentric surface 25. The V-shaped cut comprises a pair of intersecting surfaces 30 and 31 which are concentric about longitudinal axis 23. The intersection 32 of surfaces 30 and 31 define a circumference and diameter which is substantially equal to girdle 12 of diamond 10.

Figure 4:
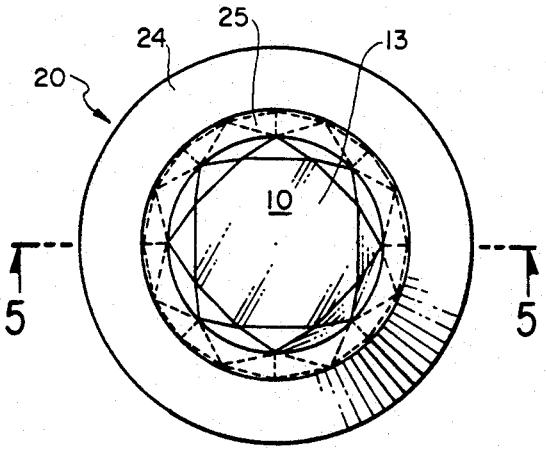
FIG. 4 is a top plan view of a gemstone secured within the mounting collar shown in FIG. 2.
Figure 5:
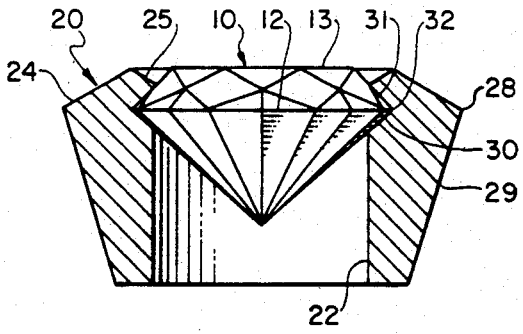
FIG. 5 is a side elevation, cross-sectional view of the gemstone and collar shown in FIG. 4 taken through line 5—5 of FIG. 4.

The mounting of diamond 10 within collar 20 can be best seen by reference to FIG. 4 and FIG. 5. Diamond 10 is uniformly secured within collar 20. As shown in FIG. 5, girdle 12 of diamond 10 is substantially adjacent intersection 32. When mounted, surfaces 30 and 31 lie adjacent to and engage portions of the surfaces of pavilion 14 and crown 11 respectively. The full extent of pavilion 14 extends within cylindrical bore 22. When mounted, the visible features of the assembly comprise the table 13, the exposed facets 15, 16 and 17 of crown 11 and inner and outer concentric surfaces 25 and 24, respectively.

The primary objective of the present invention is to permit a diamond of a given size to simulate the appearance of a larger stone. The manner in which this objective is achieved by the present invention can be best seen by reference to FIG. 5. If the diamond 10 shown in FIG. 5 represents a 2 point diamond, the diameter of girdle 12 is approximately 1.7 millimeters. As will be explained in greater detail hereinbelow, the simulated appearance of the mounted diamond 10 will be measured by the outer edge 28 of collar 20. Where the mounted stone is a 2 point diamond, the simulated appearance will be that of a 5 point diamond having a 2.4 millimeter diameter measured at outer edge 28.

Figure 6:
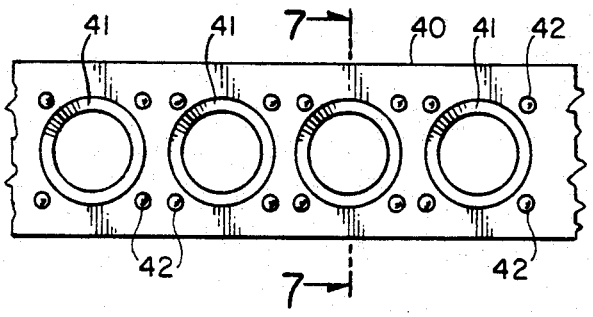
FIG. 6 is a top plan view of a setting adapted to receive a gemstone-collar assembly.
Figure 7:
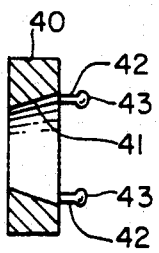
FIG. 7 is a side elevation, cross-sectional view of the setting shown in FIG. 6 taken through line 7—7 of FIG. 6.

As stated, the present invention may be incorporated in jewelry using conventional prong or channel settings. A diamond mounted in accordance with the present invention may be assembled into a ring, bracelet or other jewelry and replace a stone of substantially greater size. A typical prong setting which can be used with the present invention is shown in FIGS. 6 and 7. The setting depicted in FIG. 6 and 7 can represent a ring, bracelet, pendant or the like, the configuration not being part of the present invention. It is further understood the size of the jewelry base may be customized to conform to the size of the stones being mounted.

The frame or base 40 is adapted to receive a plurality of adjacent assemblies of diamonds 10 each mounted within a respective collar 20. A plurality of tapered openings are uniformly disposed through base 40, each being adapted to snugly receive a partial conical section 29. Surrounding each tapered opening 41 is a set of prongs 42 which will be tightened against outer edge 28 of collar 20 so that the tips 43 will grip or otherwise impose pressure upon outer concentric surface 24 of collar 20. Frame 40 may be produced in a variety of shapes and sizes, and from various types of material to enhance the decorative effect of the jewelry piece. However, any such assembly must include a suitably shaped frame 40 with tapered openings 41 for accommodating partial conical sections 29. Frame 40 may be formed of a relatively inexpensive metal if the gemstones are positioned so densely that frame 40 is not see in the finished piece. Otherwise, frame 40 is to be made from a decorative material, such as gold or platinum.

Figure 8:
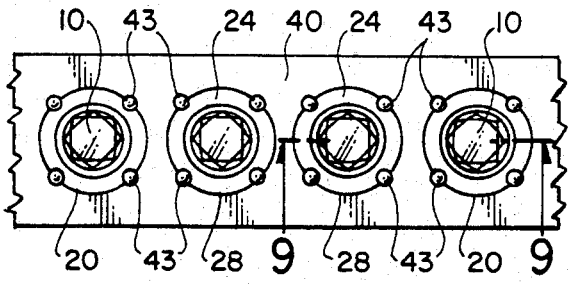
FIG. 8 is a top plan view of the gemstone-collar assembly shown in FIG. 4 mounted within the setting shown in FIG. 6.
Figure 9:
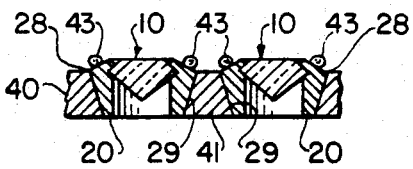
FIG. 9 is a side elevation, cross-sectional view of mounted gemstone-collar assemblies as shown in FIG. 8 taken through line 9—9 of FIG. 8.

The assembly of a plurality of jewelry settings in accordance with the present invention may be best seen by reference to FIGS. 8 and 9 wherein a pair of mounted settings are shown. As seen in FIG. 9, each collar 20 is firmly seated within a respective one of the tapered openings 41. The tips 43 of prongs 42 are bent inwardly toward the longitudinal axis of each collar 20 and are firmly seated against outer concentric surface 24 thereby firmly securing the setting within base 40. When in place, each setting of a diamond 10 will simulate the appearance of a stone having a circumference and diameter equivalent to outer edge 28. To further enhance the simulation, outer concentric surface 24 and inner concentric surface 25 may be etched or otherwise be inscribed with indicia or patterns which duplicate or give the illusion of the crown facets 15, 16 and 17 of diamond 10. In addition, the etched or inscribed indicia will provide reflecting surfaces which enhance the illusion of a larger stone.

It is therefore seen the present invention provides an improved structure and method to enhance the appearance of small gemstones. By uniformly securing a portion of crown 11 beneath inner concentric surface 25, the present invention eliminates the need to use a prong setting on extremely small gemstones. Furthermore, since indicia may be disposed upon the full extent of inner and outer concentric surfaces 24 and 25, the full reflecting capability of metallic surfaces is utilized. When a plurality of diamonds 10 are mounted in collars 20 in accordance with the present invention, they may be densely assembled upon a frame 40 to enhance the overall appearance of the jewelry. Most importantly, each mounted diamond 10 will give the appearance of a diamond which is substantially larger in size.

I claim:

1. A jewelry setting for holding a decorative element comprising:

(a) a gemstone having a crown member with a table surface and crown facets and a pavilion member; and (b) an annular collar having an outer engagement surface, an upper reflecting surface and a central bore disposed therethrough along the longitudinal axis of said collar, said upper reflecting surface comprising outer and inner concentric surfaces intersecting along a common edge, said outer concentric surface having an outer edge integral with said outer engagement surface, said gemstone being secured within said central bore, said upper reflecting surface being uniformly disposed adjacent a portion of said crown member and being coextensive with the table surface of said gemstone.

2. A jewelry setting as defined in claim 1 wherein said outer and inner concentric surfaces include inscribed indicia thereon.

3. A jewelry setting as defined in claim 2 wherein said inscribed indicia are patterned after and simulate the crown facets of said gemstone.

4. A jewelry setting as defined in claim 1 wherein said outer engagement surface comprises a partial conic section having an upper edge and lower edge uniformly disposed about the longitudinal axis of said collar, the upper edge being integral with the outer edge of said outer concentric surface, the lower edge of said partial conic section having a diameter which is less than the diameter of the upper edge.

5. A jewelry setting as defined in claim 1 wherein said central bore comprises a cylindrical surface circumscribing the longitudinal axis of said annular collar and having a lower edge coextensive with the lower edge of said outer engagement surface, a V-shaped cut being disposed about the surface of said cylindrical bore adjacent the inner edge of said upper reflecting surface, said V-shaped cut being adapted to snugly engage and be uniformly disposed about a portion of the crown member and the pavilion member of said gemstone.

6. A jewelry setting as defined in claim 1 wherein the gemstone secured within said annular collar simulates the appearance of a gemstone 250% larger.

7. A jewelry setting for holding a decorative element comprising:

(c) a gemstone having a crown member with a table surface and crown facets and a pavilion member;

(d) an annular collar having an outer engagement surface comprising a partial conic section having upper and lower edges uniformly disposed about the longitudinal axis of said collar, an upper reflecting surface adjacent the upper edge of said partial conic section and a central bore disposed through said collar about the longitudinal axis thereof, said upper reflecting surface comprising outer and inner concentric surfaces intersecting along a common edge, said outer concentric surface having an outer edge integral with said outer engagement surface, said gemstone being secured within said central bore, the upper reflecting surface being uniformly disposed adjacent a portion of the crown member of said gemstone; and (e) a frame having a top and bottom surface and a plurality of tapered, conical openings disposed therethrough, the diameter of the openings at the top surface of said frame being greater than the openings at the bottom surface of said frame, said tapered openings being adapted to receive and uniformly engage the outer engagement surface of said annular collar and setting means adjacent each of said tapered openings for engaging the upper reflecting surface of said annular collar.

8. A jewelry setting as defined in claim 7 wherein said outer and inner concentric surfaces include inscribed indicia thereon.

9. A jewelry setting as defined in claim 8 wherein said inscribed indicia are patterned after and simulate the crown facets of said gemstone.

10. A jewelry setting as defined in claim 7 wherein said central bore comprises a cylindrical surface circumscribing the longitudinal axis of said annular collar and having a lower edge coextensive with the lower edge of said outer engagement surface, a V-shaped cut being disposed about the surface of said cylindrical bore adjacent said upper reflecting surface, said V-shaped cut being adapted to snugly engage and be uniformly disposed about a portion of said crown member and said pavilion member.

11. A jewelry setting as defined in claim 7 wherein the gemstone secured within said annular collar simulates the appearance of a gemstone 250% larger.

* * * * *